US011964734B2

(12) United States Patent
Scott

(10) Patent No.: US 11,964,734 B2
(45) Date of Patent: Apr. 23, 2024

(54) TRANSOM LIFT FOR BOATS

(71) Applicant: William A. Scott, Johns Island, SC (US)

(72) Inventor: William A. Scott, Johns Island, SC (US)

( * ) Notice: Subject to any disclaimer, the term of this patent is extended or adjusted under 35 U.S.C. 154(b) by 373 days.

(21) Appl. No.: 17/506,044

(22) Filed: Oct. 20, 2021

(65) Prior Publication Data

US 2023/0119944 A1 Apr. 20, 2023

(51) Int. Cl.
*B63B 27/14* (2006.01)
*B63B 27/16* (2006.01)
*B63B 27/36* (2006.01)

(52) U.S. Cl.
CPC ..... *B63B 27/14* (2013.01); *B63B 27/16* (2013.01); *B63B 27/36* (2013.01)

(58) Field of Classification Search
CPC ..... B63B 27/00; B63B 27/14; B63B 27/16; B63B 27/36; B63B 29/00; B63B 29/20; B63B 17/00
USPC ..... 114/362
See application file for complete search history.

(56) References Cited

U.S. PATENT DOCUMENTS 3,143,991 A 8/1964 Anderson
4,907,673 A * 3/1990 Ginter ..... B63B 27/14 114/362
6,598,562 B1 * 7/2003 Dutkiewicz ..... E06C 1/39 182/93
6,938,572 B1 * 9/2005 Besecker ..... B63B 27/146 114/361
7,293,521 B1 11/2007 Johns, Jr. et al.
8,267,620 B2 9/2012 Wood, II et al.
8,596,212 B2 * 12/2013 Perkins ..... B63B 27/146 114/362
2006/0272895 A1 * 12/2006 Lavoie ..... B63B 27/146 182/127

FOREIGN PATENT DOCUMENTS

WO WO2018151684 8/2018

* cited by examiner

*Primary Examiner* — Lars A Olson
(74) *Attorney, Agent, or Firm* — B. Craig Killough

(57) ABSTRACT

A transom lift for boats that can be used for loading and transporting objects such as a dinghy or large coolers. The transom lift has generally parallel and vertical members that fit inside of generally vertical and parallel sides of transom mount ladders. Hooks extend from the generally parallel, spaced apart, elongated, and vertical members, and are constructed and arranged to fit over steps of the transom mount ladder. A supported planar member or platform extends from a lower portion of the generally vertical, spaced apart, elongated, and parallel members. The transom lift is raised and lowered by pulling on an upper end of the transom lift using the transom mount ladder as a guide for vertical movement of the transom lift. The hooks position and hold the planar member or platform in the desired vertical position, either above or below the water line.

6 Claims, 11 Drawing Sheets

TRANSOM LIFT FOR BOATS

BACKGROUND OF THE INVENTION

It is frequently desirable for a boat to have a dinghy or similar tender that travels with the boat. A particular example is a sailboat having a keel that may extend four or more feet below the water line of the boat. The presence of the keel means that a dinghy or tender is necessary for passengers and crew to reach land without swimming to land. However, particularly on recreational vehicles, and even those of large size, transporting a dinghy takes up valuable space in or on the boat.

Accordingly, many boats store the dinghy on the transom of the boat. However, devices for attaching a dinghy are cumbersome and expensive, and usually require fixing a mounting bracket or other foundation to the boat. A mounting usually requires drilling undesirable holes into the boat hull, which is usually fiberglass. Further, known devices for mounting a dinghy to the transom of a boat are expensive, frequently costing $1500.00 or more.

There is a need for a transom lift for boats that is inexpensive and easy to use and to which a dinghy can be mounted for transport by the boat without taking up valuable space on the deck of the boat or in a cockpit or cabin of the boat. There is a need for a transom lift that permits the presence of a transom mount ladder.

SUMMARY OF THE INVENTION

The present invention is a transom lift for boats that can be used for transporting a dinghy. The device provides a platform that can also be used for storing and transporting other objects, such as large coolers. Further, the present invention can also be used as a swim platform.

The transom lift according to the invention has generally parallel and vertical members that fit inside of generally vertical and parallel sides of transom mount ladders found on boats, and particularly sail boats. Hooks extend from the generally parallel members, and are constructed and arranged to fit over the steps of the transom mount ladder. A supported planar member or platform extends from a lower portion of the generally vertical spaced apart elongated and parallel members. The transom lift is manually raised and lowered by pulling on an upper end of the transom lift using the transom mount ladder as a guide for vertical movement of the transom lift. Hooks are positioned relative to the steps of the transom mount ladder to position the planar member or platform in the desired vertical position, which may be positioned above or below the water line.

BRIEF DRAWING DESCRIPTION

DESCRIPTION OF PREFERRED EMBODIMENTS

Figure 1:
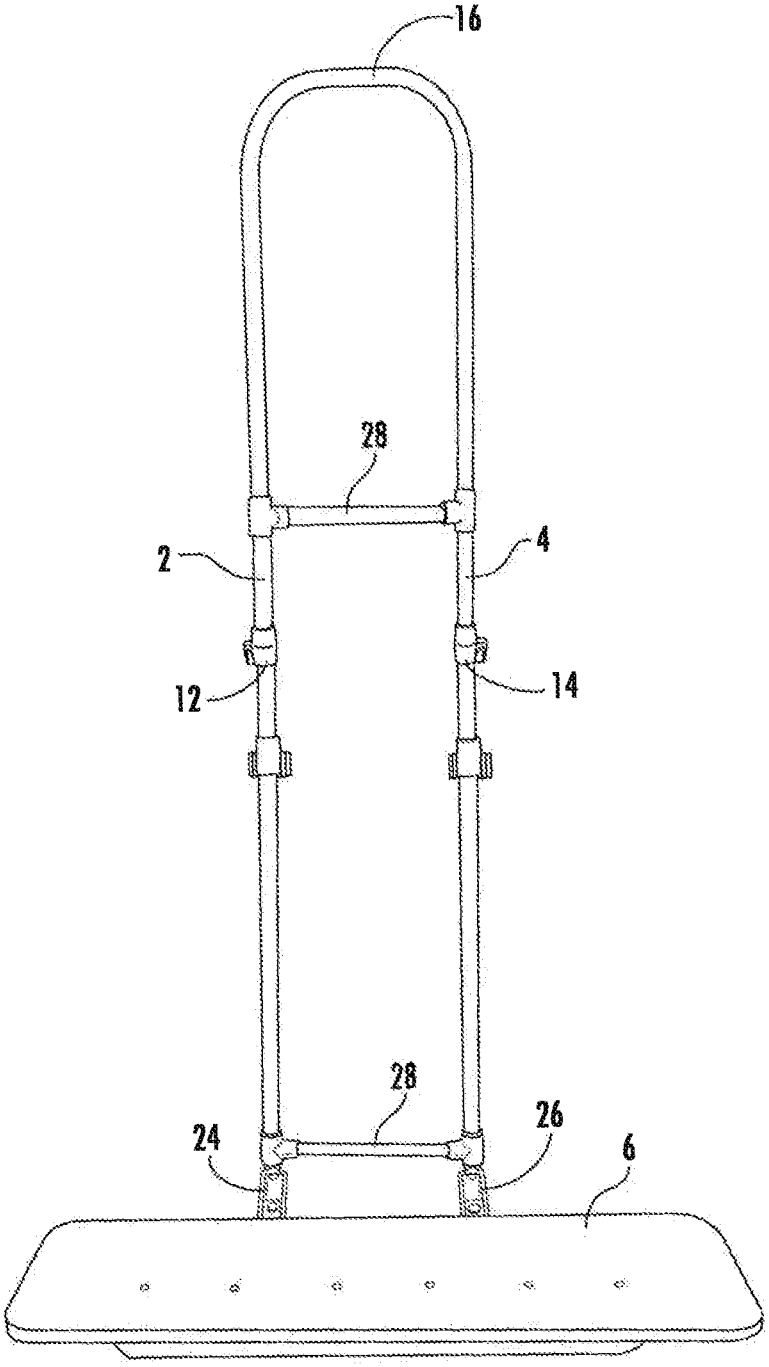
FIG. 1 shows a front isolation view of the transom lift for boats according to the invention.

FIG. 1 shows the transom lift for boats in isolation and not engaging a transom mount ladder. The transom lift comprises generally vertical, spaced apart, elongated and parallel members 2,4. These members are defined by a left side and a right side that are connected at an upper end. In a preferred embodiment, the upper end is formed as having a generally arcuate shape on a left side and a generally arcuate shape on a right side, with a generally horizontal top portion that forms a handle 16 for assisting vertical movement of the transom lift for boats.

In a preferred embodiment, the left side and the right side of the generally vertical, spaced apart, elongated and parallel members 2,4 are hinged. The hinges 12,14 are preferred to be approximately midway between an upper end of a handle of the generally vertical, spaced apart, elongated, and parallel members and the planar member or platform 6.

Structural supports 28 may be provided between the generally vertical, spaced apart, elongated, and parallel members to provide rigidity for the transom lift. As shown in FIG. 1, two (2) generally horizontal structural supports are provided that join the left side to the right side of the generally vertical, spaced apart, elongated, and parallel members 2,4, with one support present above the hinges 12,14 and one support present at a lower end of the generally vertical, spaced apart, elongated, and parallel members.

Figure 2:
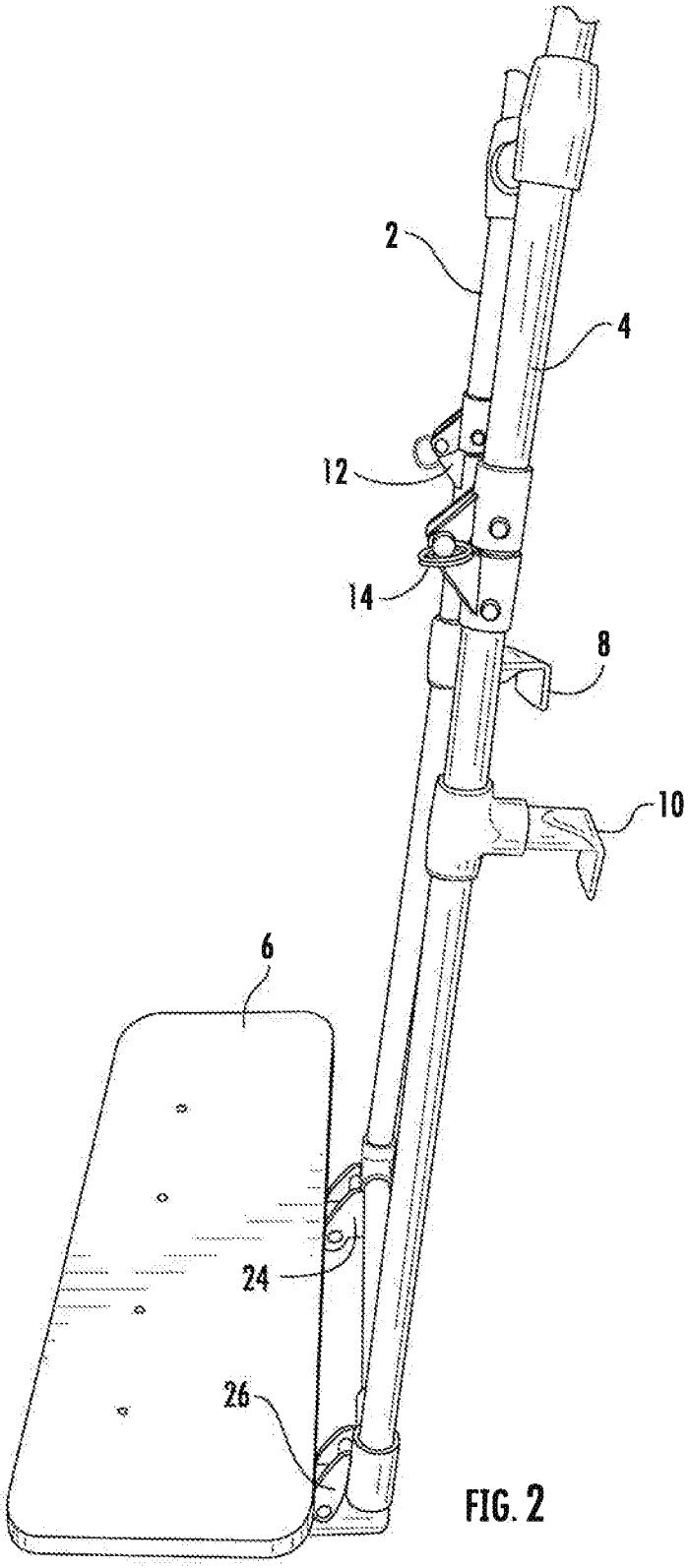
FIG. 2 shows a side isolation view of a portion of the transom lift for boats according to the invention.

As shown in FIG. 2, the transom lift for boats comprises hooks 8,10 that are constructed and arranged for positioning over a step of the transom mount ladder 30. The hooks are preferred to extend generally horizontally from the left side and right side of the generally vertical, spaced apart, elongated, and parallel members 2,4. The hooks may have a generally vertical portion as shown in this embodiment. The generally vertical portion of the hooks is present opposite the left side and the right side of the generally vertical, spaced apart, elongated, and parallel members, and extends vertically downward.

Further, as shown in the drawing figures, the platform 6 extends from the generally vertical, spaced apart, elongated, and parallel members 2,4 and opposite the hooks 8,10. The platform is supported and preferred to be generally planar on a top surface thereof, and is positioned generally horizontally and extending from the generally vertical, spaced apart, elongated, and parallel members.

Figure 4:
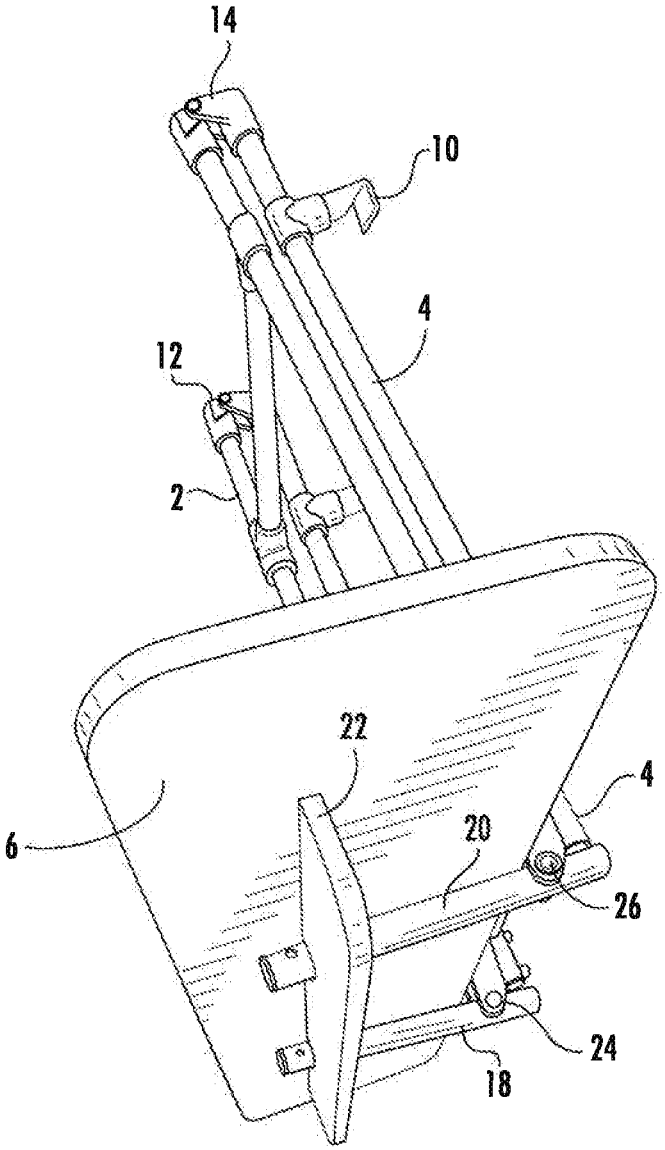
FIG. 4 shows a bottom perspective view of the transom lift for boats.
Figure 5:
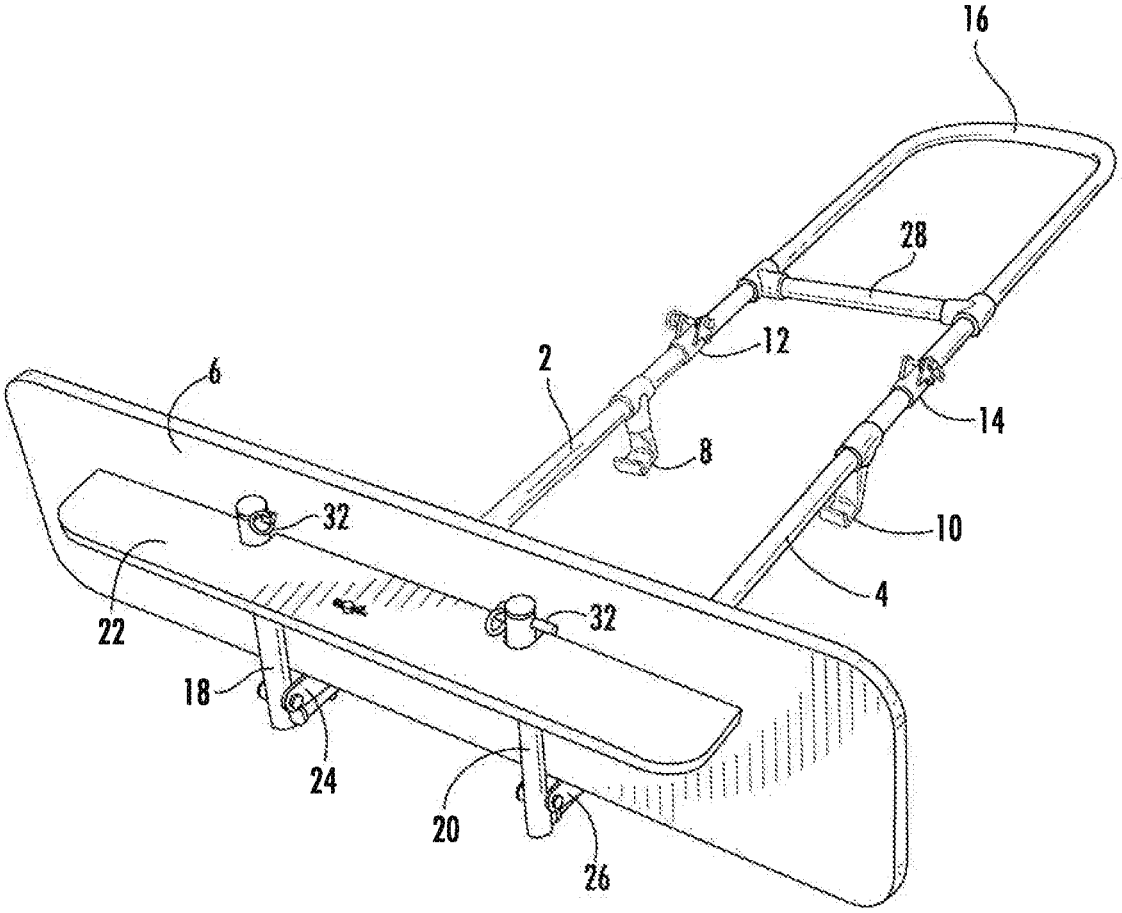
FIG. 5 shows an additional bottom perspective view of the transom lift for boats.

As shown in FIG. 4, a pair of spaced apart supports 18,20 extend from a lower end of the generally vertical, spaced apart, elongated, and parallel members 2,4 with one of the supports extending from the left side, and one of the supports extended from the right side. The supports extend generally horizontally from the generally vertical, spaced apart, elongated, and parallel members.

The spaced apart supports 18,20 may be joined to a member 22 that extends downwardly from the platform for mounting the platform to the spaced apart supports. The spaced apart supports may engage voids in the member 22 that allow the platform 6 to be removed from the transom lift. Removable pins 32 may be positioned at or near the end of the spaced apart supports that hold the platform in position but allow the platform to be removed as desired.

Figure 3:
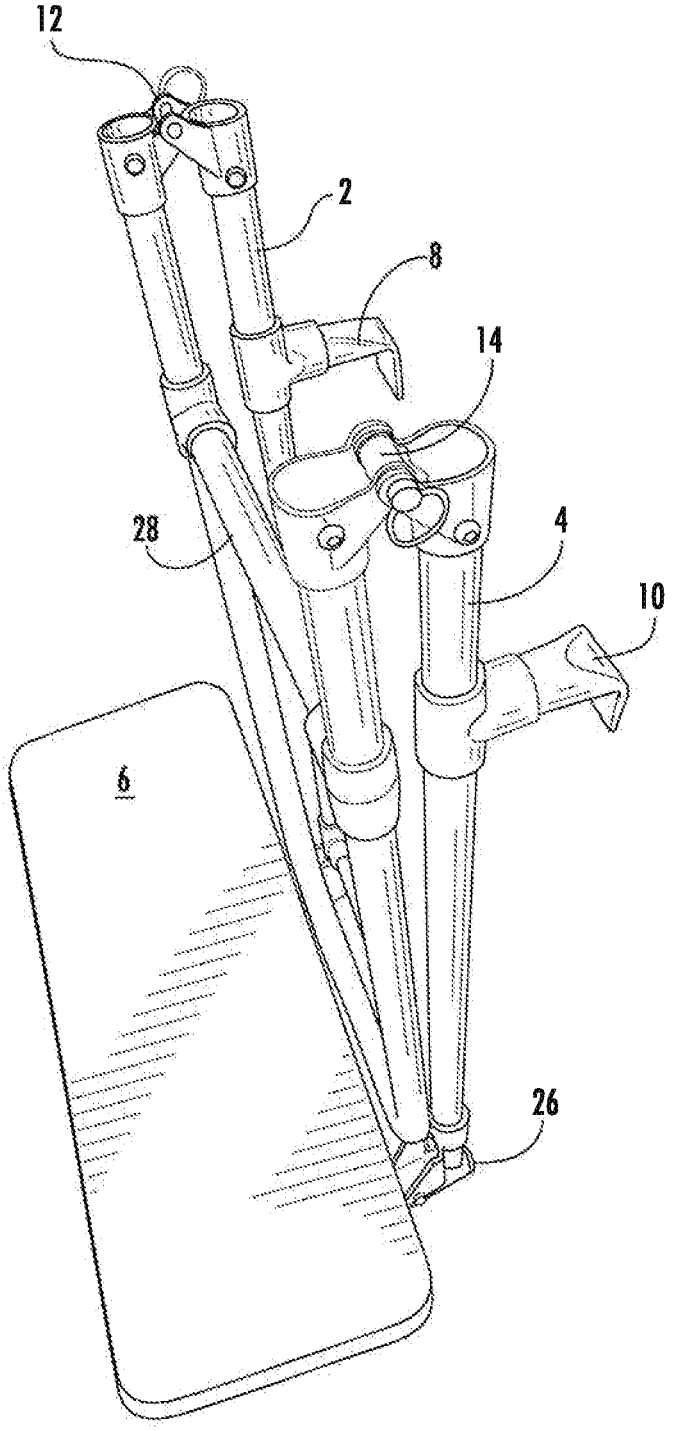
FIG. 3 shows the transom lift for boats of FIG. 2 with an upper portion of the transom lift for boats folded relative to a lower portion of the transom lift for boats.

In a preferred embodiment, the spaced apart supports are hingeably connected to the generally vertical spaced apart elongated and parallel members. Hinges 24,26 allow the platform to be folded upwardly for storage. Similarly, as shown in FIG. 3 and FIG. 4, the upper portion of the generally vertical spaced apart elongated and parallel members may also be folded so that the upper right side becomes generally parallel to the lower right side, and the upper left side becomes generally parallel to the lower left side. These hinges allow storage of the device when not in use since storage is limited on most boats, and particularly sailboats.

Figure 6:
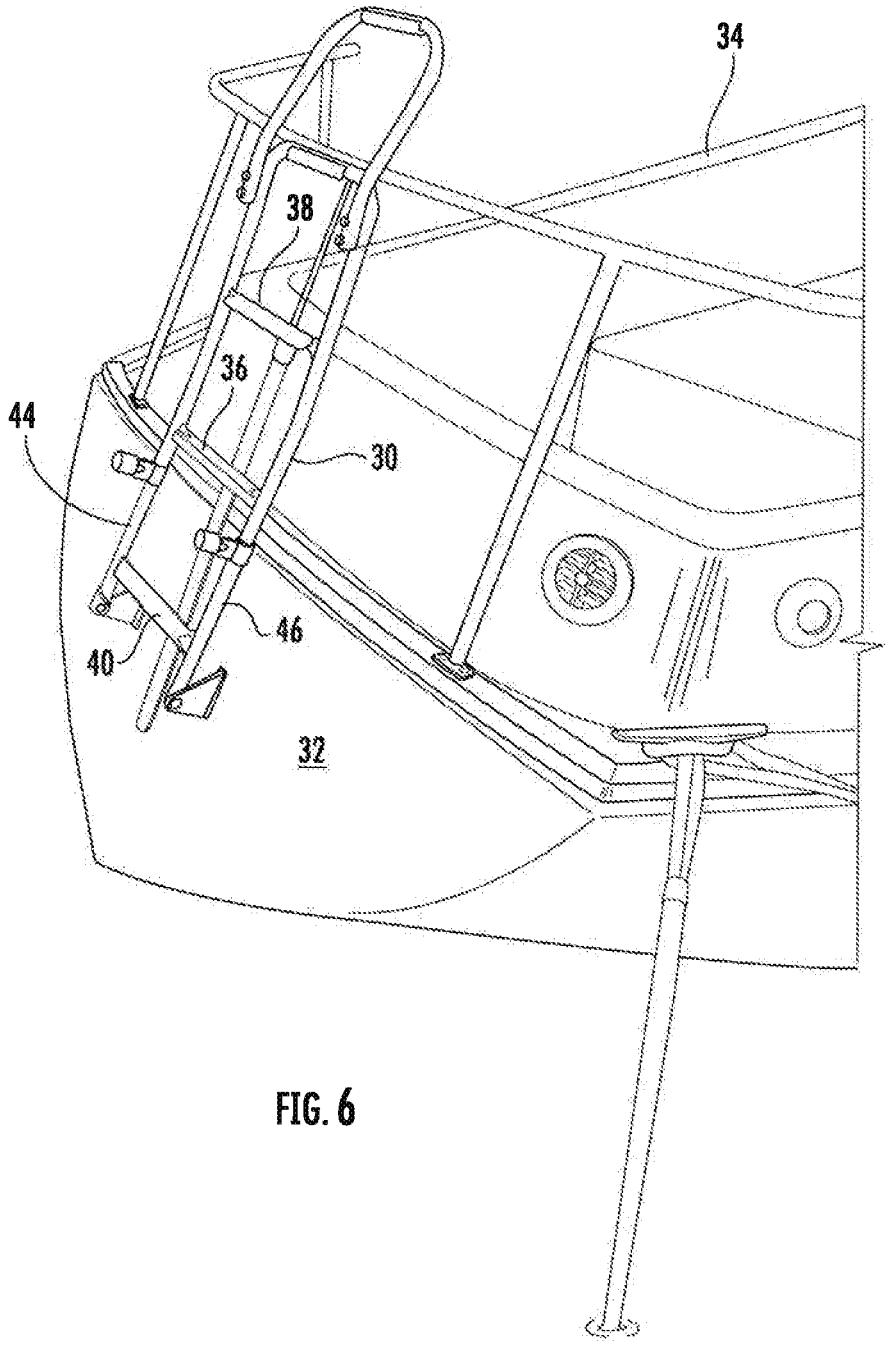
FIG. 6 shows a transom of a sailboat with a transom mount ladder mounted to the transom of the sailboat, with the transom mount ladder folded upwardly.

FIG. 6 demonstrates the transom mount ladder 30 mounted to the transom 32 of a sailboat 34. The transom mount ladder has a plurality of steps, demonstrated by steps 36,38, 40. As shown in FIG. 6, the transom mount ladder is positioned in an upward and generally vertical position so that the steps are inverted. The transom mount ladder is placed in this position by the ladder being hingeably connected to the transom of the sailboat, as is typical for transom mount ladders on sailboats. The sailboat that is shown has what is known as a reverse transom. That is, the lower portion of the transom extends further out than the upper portion of the transom. Reverse transom sailboats are particularly desirable when the transom lift of the present invention is used, with the angle of the reverse transom aiding lifting and positioning of the transom lift.

Figure 7:
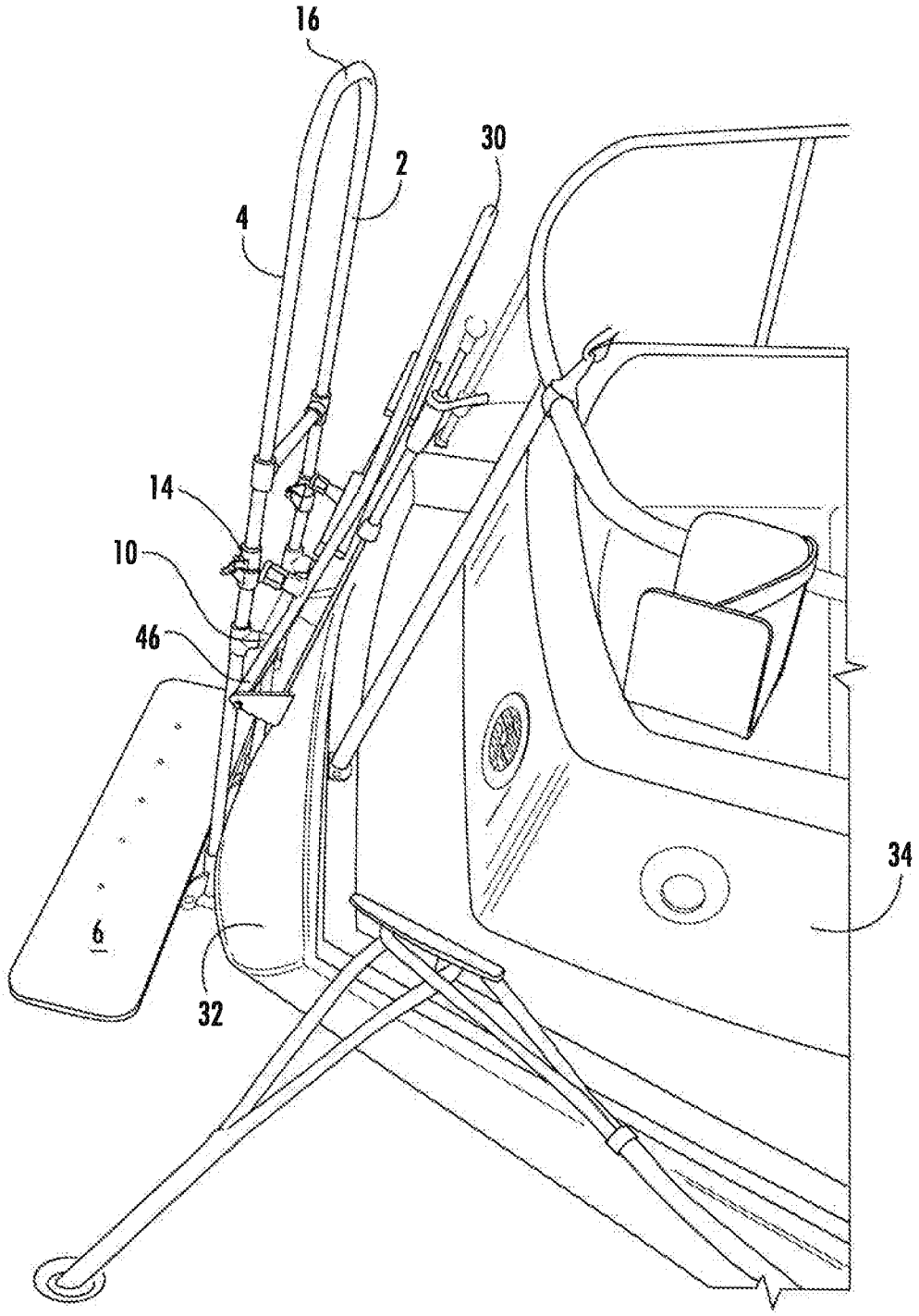
FIG. 7 shows the transom lift for boats mounted to the transom mount ladder that is fixed to the transom of the sailboat.

FIG. 7 shows a transom lift according to an embodiment of the invention mounted to the transom mount ladder 30 that is in the inverted position shown in FIG. 6 so that the steps are inverted. The hooks 8,10 are positioned over step 40 of the inverted transom mount ladder. The hooks are positioned over the step with the generally horizontal portion of hooks being positioned over the step, with the generally vertical portion of the hook extending over the side of the step of the transom mount ladder that is closest to the transom of the sailboat.

Figure 8:
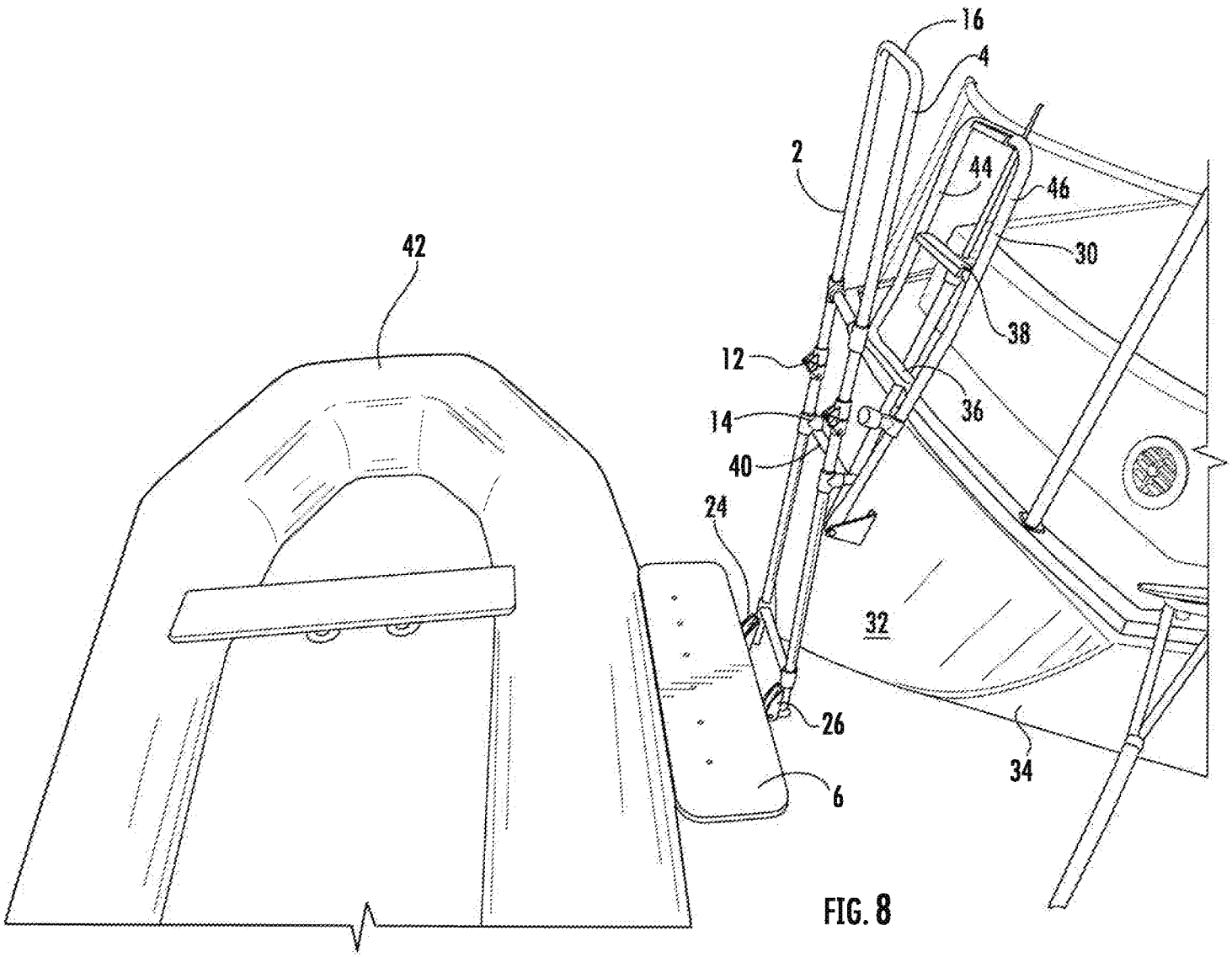
FIG. 8 shows the transom lift for boats with a dinghy positioned adjacent to the planar member or platform of the transom lift for boats.
Figure 11:
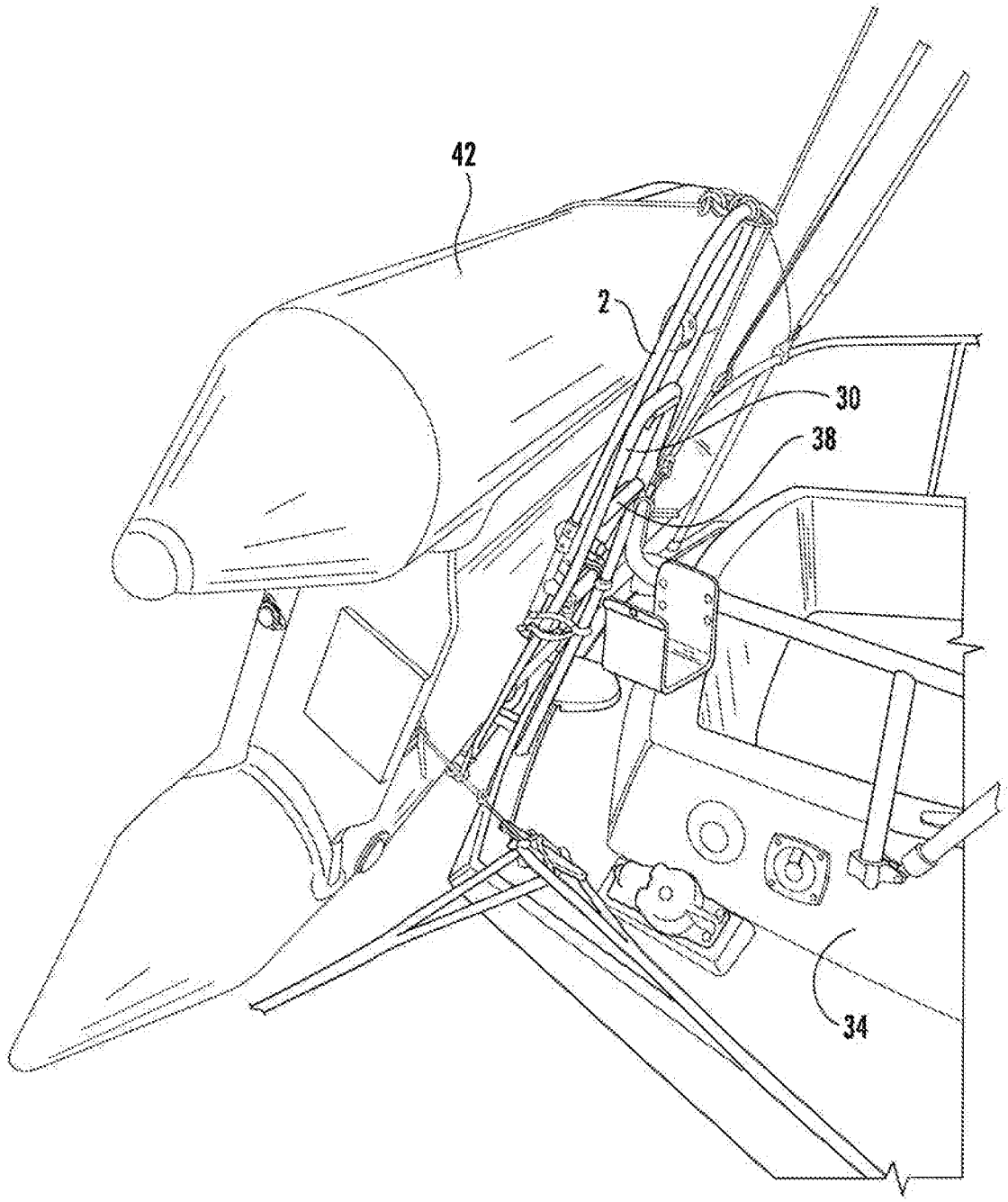
FIG. 11 shows the transom lift for boats with a dinghy positioned vertically on the planar member or platform of the transom lift for boats, with the platform above the water line and the dinghy positioned for transport by the boat.

FIG. 8 shows another view of the transom lift positioned on the transom mount ladder 30 and in the position shown in FIG. 7. A dinghy is 42 positioned adjacent to the platform 6 and ready for loading. In this view, the dinghy is floating in water and the platform is positioned below the water line by virtue of the hooks being positioned on the lowest step 40 when the transom mount ladder is positioned in the inverted position. The dinghy is rotated to the vertical position as shown in FIG. 11. The dinghy may be secured by a line tied to the dinghy and the transom lift and other structures of the sailboat. The transom lift is pulled upwardly using the transom mount ladder as a guide as described. The transom lift and dinghy are positioned above the water line for transport.

Figure 9:
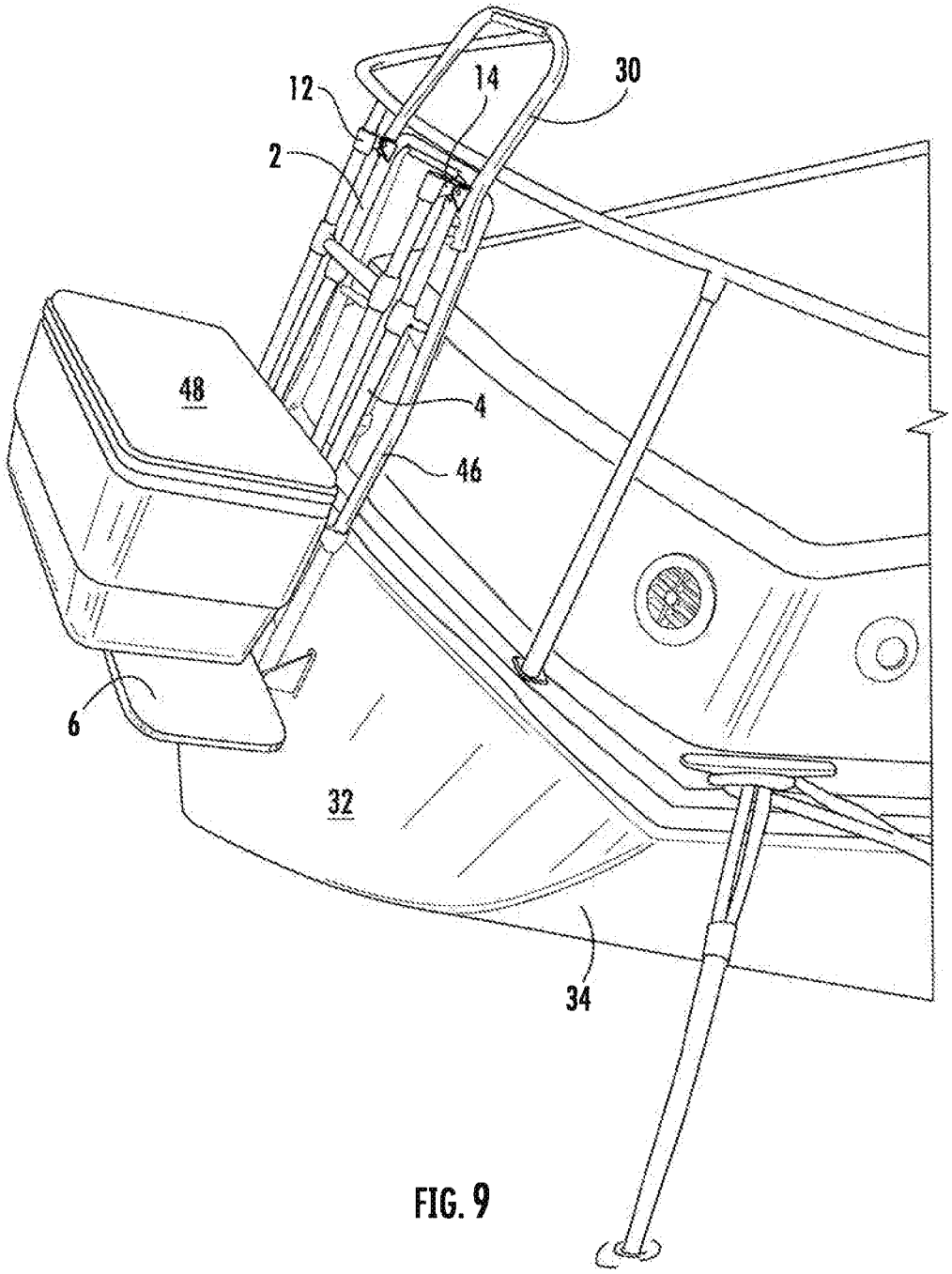
FIG. 9 shows the transom mount ladder for boats moved from engaging an inverted step according to FIG. 8 to a higher inverted step of the transom mount ladder in FIG. 9 so that the platform is moved above the water line.

FIG. 9 demonstrates the transom mount lift having been repositioned to a higher step 38 on the inverted ladder by pulling upwardly on the handle 16 of the transom lift. The pair of generally vertical, spaced apart, elongated, and parallel members 2, 4 are positioned inside of the generally vertical spaced apart and parallel supports of the transom mount swim ladder. Since the pair of generally vertical spaced apart, elongated, and parallel members are between the generally vertical and spaced apart supports 44,46 for the swim ladder, the generally vertical and spaced apart supports of the swim ladder act as a guide or track as the transom lift is manually pulled upwardly from the position of FIG. 8 to the position of FIG. 9. The transom lift may be pulled upwardly by the handle 16, or it may be pulled upwardly using a halyard of the boat or other mechanical device.

The dinghy 42 may be mounted to the platform 6 by rotating the dingy about 90° from the position of FIG. 8 so that a side of the dinghy rests on the platform 6. The transom lift may then be repositioned so that the platform is above the water line as shown in FIG. 9, which is the desired position when the boat or sailboat is underway. FIG. 9 shows the platform as having a large cooler 48 positioned thereon. FIG. 9 shows the upper portion of the generally vertical, spaced apart, elongated and parallel members 2,4 folded to the position shown in FIG. 4.

Figure 10:
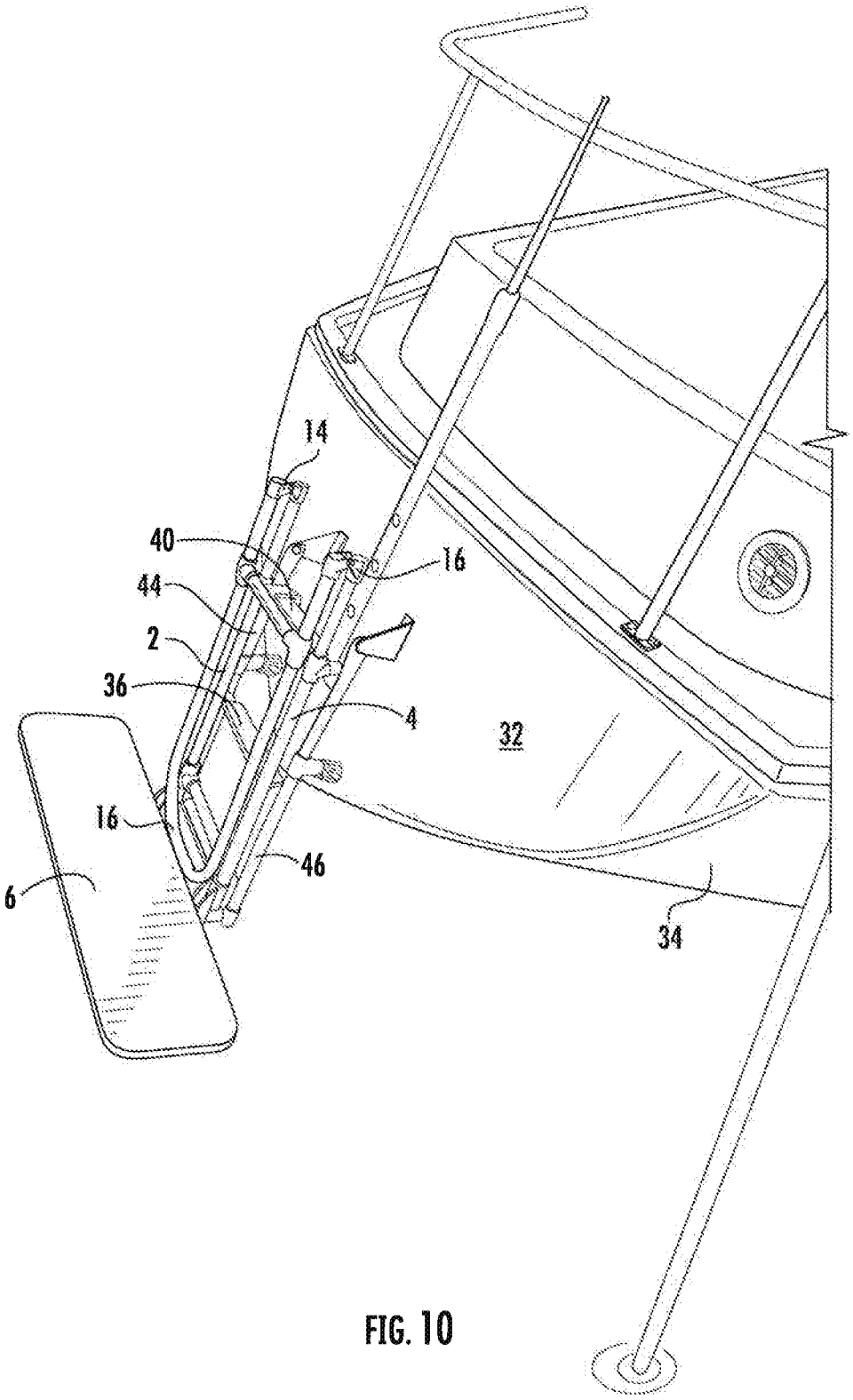
FIG. 10 shows the transom mount ladder moved to a full downward position, with the transom lift for boats mounted by means of the hooks to the transom mount ladder, so that the platform is fully below the water line.

The transom lift may also be positioned substantially below the water line as shown in FIG. 10. When the transom mount ladder 30 is folded downwardly, the transom lift may be positioned on a step of the transom mount ladder. The transom mount ladder is not inverted. Normally, positioning the platform on the top step 40 when the transom mount ladder is not inverted will place the platform 6 at a sufficient depth for practical use.

What is claimed:

1. A transom lift for boats, comprising:

a pair of generally vertical, spaced apart, elongated and parallel members further comprising an arcuate connector connecting a left side of the generally vertical, spaced apart, elongated and parallel members with a right side of the generally vertical, spaced apart, elongated and parallel members connected at an upper end;

a pair of spaced apart supports, with one of the spaced apart supports extending generally horizontally from the left side of the generally vertical, spaced apart, elongated and parallel members and another of the spaced apart supports extending from the right side of the generally vertical, spaced apart, elongated and parallel members;

a planar member that is positioned above and connected to the spaced apart supports;

a pair of hooks positioned above the planar member, with one of the hooks extending from the left side of the generally vertical, spaced apart, elongated and parallel members and another of the spaced apart supports extending from the right side of the generally vertical, spaced apart, elongated and parallel members, and extending to a side of the generally vertical, spaced apart, elongated, and parallel members that is opposite the side of the generally vertical, spaced apart, elongated and parallel members member from which the pair of spaced apart supports extend, wherein the pair of hooks is each constructed and arranged to extend over and beside a step of a transom ladder of a boat, wherein the left side of the generally vertical, spaced apart, elongated and parallel members and the right side of the generally vertical, spaced apart, elongated and parallel members are constructed and arranged to fit within and between a pair of generally vertical and parallel members that form the transom ladder of a boat, and wherein the pair of generally vertical and parallel members that form the transom ladder act as a guide for raising and lowering the transom lift.

2. A transom lift for boats as described in claim 1, wherein the spaced apart supports are each connected to one of the generally vertical, spaced apart, elongated and parallel members by a hinge that permits the planar member to be moved to a position that is generally parallel with the generally vertical, spaced apart, elongated and parallel members.

3. A transom lift for boats as described in claim 1, wherein the left side of the generally vertical, spaced apart, elongated and parallel members and the right side of the generally vertical, spaced apart, elongated and parallel members are joined at a top of the left side of the generally vertical, spaced apart, elongated and parallel members and at a top of the right side of the generally vertical, spaced apart, elongated and parallel members by an arcuate member having the shape of an inverted U, the arcuate member forming a handle for vertical movement of the transom lift relative to the transom ladder.

4. A transom lift for boats as described in claim 3, further comprising a hinge that is positioned in the left side of the generally vertical, spaced apart, elongated and parallel members and a hinge that is positioned in the right side of the generally vertical, spaced apart, elongated and parallel members, with each hinge positioned below the arcuate member and above the planar member, wherein the hinge that is positioned in the left side of the generally vertical, spaced apart, elongated and parallel members and the hinge that is positioned in the right side of the generally vertical, spaced apart, elongated and parallel members permit an upper portion of the inverted U shaped member to be positioned generally parallel to a lower portion of the inverted U shaped member.

5. A transom lift for boats as described in claim 1, wherein an upper portion of the left side of the generally vertical, spaced apart, elongated and parallel members and an upper portion of the right side of the generally vertical, spaced apart, elongated and parallel members are formed as a continuous and unitary member having an arcuate portion in the shape of an inverted U, the arcuate portion forming a handle for vertical movement of the transom lift relative to the transom ladder.

6. A transom lift for boats as described in claim 1, wherein with one of the spaced apart supports is hingeably connected to the left side of the generally vertical, spaced apart, elongated and parallel members and another of the spaced apart supports is hingeably connected to the right side of the generally vertical, spaced apart, elongated and parallel members.

* * * * *